US011306408B2

(12) United States Patent
Zhang et al.

(10) Patent No.: US 11,306,408 B2
(45) Date of Patent: Apr. 19, 2022

(54) DEVICE FOR MICROELECTRODEPOSITION THROUGH LASER ASSISTED FLEXIBLE FOLLOWING TOOL ELECTRODE AND DEPOSITION METHOD USING THE DEVICE THEREOF

(71) Applicant: Jiangsu University, Jiangsu (CN)

(72) Inventors: Zhaoyang Zhang, Jiangsu (CN); Yucheng Wu, Jiangsu (CN); Kun Xu, Jiangsu (CN); Xueren Dai, Jiangsu (CN); Anbin Wang, Jiangsu (CN); Qinming Gu, Jiangsu (CN); Hong Wang, Jiangsu (CN)

(73) Assignee: Jiangsu University, Jiangsu (CN)

( * ) Notice: Subject to any disclaimer, the term of this patent is extended or adjusted under 35 U.S.C. 154(b) by 0 days.

(21) Appl. No.: 17/296,552

(22) PCT Filed: Jan. 19, 2020

(86) PCT No.: PCT/CN2020/072902
§ 371 (c)(1),
(2) Date: May 25, 2021

(87) PCT Pub. No.: WO2020/168881
PCT Pub. Date: Aug. 27, 2020

(65) Prior Publication Data

US 2022/0010448 A1 Jan. 13, 2022

(30) Foreign Application Priority Data

Feb. 20, 2019 (CN) ..... 201910125271.2

(51) Int. Cl.
*C25D 5/02* (2006.01)
*C25D 5/04* (2006.01)
(Continued)

(52) U.S. Cl.
CPC ..... *C25D 5/024* (2013.01); *C25D 5/04* (2013.01); *C25D 5/18* (2013.01); *C25D 21/06* (2013.01); *C25D 21/10* (2013.01)

(58) Field of Classification Search
CPC ..... C25D 5/024; C25D 5/011; C25D 1/00–22
(Continued)

(56) References Cited

U.S. PATENT DOCUMENTS 4,430,164 A 2/1984 Daroczy et al.
4,430,165 A 2/1984 Inoue

FOREIGN PATENT DOCUMENTS

CN 103590076 2/2014
CN 104942388 9/2015
(Continued)

OTHER PUBLICATIONS

"International Search Report (Form PCT/ISA/210) of PCT/CN2020/072902," dated Apr. 9, 2020, with English translation thereof, pp. 1-6.

*Primary Examiner* — Harry D Wilkins, III
*Assistant Examiner* — Ho-Sung Chung
(74) *Attorney, Agent, or Firm* — JCIP Global Inc.

(57) ABSTRACT

Disclosed are a device and a method for microelectrodeposition through a laser assisted flexible following tool electrode. Localization of electrodeposition and dimensional precision of members are enhanced by using the flexible following tool electrode to restrict a dispersion region of an electric field and a reaction region of electrodeposition, and a complex-shaped member can be deposited by controlling a motion path of the flexible following tool electrode. Since a laser has a high power density, introducing laser irradiation changes an electrode state in a radiated region, accelerates ion diffusion and electron transfer speeds, and increases a deposition rate, thus reducing defects such as pitting and
(Continued)

cracking in a deposit, enhancing deposition quality, and achieving fabrication of a micro-part by a synergistic action of both electrochemical energy and laser energy.

6 Claims, 2 Drawing Sheets

(51) Int. Cl.
*C25D 5/18* (2006.01)
*C25D 21/06* (2006.01)
*C25D 21/10* (2006.01)

(58) Field of Classification Search
USPC ..... 205/340; 204/224 R
See application file for complete search history.

(56) References Cited

FOREIGN PATENT DOCUMENTS

| | | |
|---|---|---|
| CN | 104988546 | 10/2015 |
| CN | 107723761 | 2/2018 |
| CN | 108655521 | 10/2018 |
| CN | 109735883 | 5/2019 |
| RU | 2289640 | 12/2006 |
| WO | 2007095434 | 8/2007 |
| WO | 2009051923 | 4/2009 |

DEVICE FOR MICROELECTRODEPOSITION THROUGH LASER ASSISTED FLEXIBLE FOLLOWING TOOL ELECTRODE AND DEPOSITION METHOD USING THE DEVICE THEREOF

CROSS-REFERENCE TO RELATED APPLICATION

This application is a 371 application of the international PCT application serial no. PCT/CN2020/072902, filed on Jan. 19, 2020, which claims the priority benefit of China application no. 201910125271.2, filed on Feb. 20 2019. The entirety of each of the abovementioned patent applications is hereby incorporated by reference herein and made a part of this specification.

TECHNICAL FIELD

The present invention mainly relates to the technical field of localized microelectrodeposition, and in particular, to a method and a device for microelectrodeposition through a laser assisted flexible following tool electrode, which is suitable for processing and fabrication of a micro-metal part.

DESCRIPTION OF RELATED ART

The microelectrodeposition technology is based on electrochemical principles. Metal ions in a solution move to a cathode to obtain electrons and undergo a reduction reaction. The metal ions are continuously reduced to stack and accumulate materials on a surface of the cathode in the form of atoms and molecules, and therefore micro/nano-scale additive fabrication can be realized, thus having great room for development in the field of micro- and nano-fabrication. Laser processing is a non-contact processing method, and has advantages such as high energy density, high efficiency, and good flexibility. The introduction of laser irradiation enhances micro-region stirring, accelerates charge transfer, and improves mechanical properties of a deposited layer, thus effectively reducing defects such as pitting and cracking in a deposit. The introduction of laser irradiation into the microelectrodeposition technology can improve the deposition quality, but problems such as poor localization and inability to accurately control a size and shape of a part still exist and need to be solved urgently.

There is a lot of research on the laser assisted electrodeposition technology at home and abroad. It is proposed in Chinese Patent No. CN103590076A entitled "Laser-Reinforced Electrodeposition Rapid-Prototyping Processing Apparatus and Method" that a hollow tubular passive anode is used, side and top surfaces of the anode are wrapped by an insulating film, and a laser beam passes through the center of the anode and is irradiated above a cathode substrate, thus realizing combination of laser and electrodeposition technologies. According to a corresponding scanning path, deposition is performed point by point on the surface of the substrate. After a first layer is finished, a workbench descends to finish deposition of a second layer, and a required three-dimensional part is thus deposited layer by layer. It is proposed in Chinese Patent No. CN104988546A entitled "Method for Preparing Germanium Nano Array by Inducing Ionic Liquid Electrodeposition with Laser" that an ionic liquid electrodeposition technology and a laser irradiation technology are combined, a non-toxic pollution-free green ionic liquid 1-ethyl-3-methylimidazolium bis[(trifluoromethyl)sulfonyl]imide is used a solvent, $GeCl_4$ is used as an electrolyte, the electrolyte is irradiated by a pulsed laser, and a germanium nano array is prepared by deposition for about 1200 s. An electrodeposition reaction is mainly affected by distribution of an electric field, and the above two patents both fail to restrict the electric field well, thus having problems such as poor localization and low precision of the shape of a deposit. Using a flexible following tool electrode can effectively solve the problems and effectively enhance forming precision of a complex part.

SUMMARY

An objective of the present invention is to propose a method for microelectrodeposition through a laser assisted flexible following tool electrode. A flexible following tool electrode is used, which has an upper section being an insoluble metal wire with sidewall insulation, for restricting a dispersion region of an anode electric field; a lower section being an insulating shielding mold, for restricting a region of a cathode electrodeposition reaction; and a middle section connected by a flexible spring joint, wherein an elastic force of the spring guarantees the close contact between the lower section shielding mold and a cathode substrate during tool setting, and a buffer function of the spring further avoids damaging the insulating shielding mold. In a deposition process, as the height of a deposit increases, the shielding mold is lifted upward continuously, and therefore, metal can be continuously deposited in the shielding mold. At the same time, the flexible joint enables the shielding mold to be lifted diagonally or deviously, thus ensuring spatial movement of the tool electrode to obtain a deposit in a complex shape. By changing the shape of the shielding mold, different cross-sectional shapes can be obtained. The forming precision of a part is controlled by the shielding mold, thus achieving a higher dimensional precision. Laser irradiation enhances reaction power of the electrode, and the thermal effect accelerates the deposition speed, and promotes removal of cathode gas from the elastic joint and supplement of metal cations, thus effectively reducing defects such as cracking and pores in the deposit, and improving the deposition quality.

Another objective of the present invention is to propose a device for microelectrodeposition through a laser assisted flexible following tool electrode, which provides a complete set of processing platforms to realize electrodeposition of a complex micro-member.

The objectives of the present invention are mainly achieved through the following technical solutions:

A device for microelectrodeposition through a laser assisted flexible following tool electrode includes a workpiece processing system, a laser irradiation system, and a motion control system, wherein the workpiece processing system includes an X-Y two-coordinate workbench, a vertical lifting workbench, a direct current (DC) pulse power supply, a working tank, a flexible following tool anode, and a cathode substrate;

the flexible following tool anode is connected to a positive electrode of the DC pulse power supply and is clamped by a work arm of the X-Y two-coordinate workbench; the cathode substrate is connected to a negative electrode of the DC pulse power supply; the flexible following tool anode and the cathode substrate are arranged from top to bottom, and the flexible following tool anode and the cathode substrate are both arranged in an electrolyte in the working tank; and the working tank is arranged on the vertical lifting workbench;

the laser irradiation system includes a pulsed laser, a reflector, and a focusing lens; a laser beam emitted by the pulsed laser is reflected by the reflector, then focused by the focusing lens, and then irradiated on the flexible following tool anode; and the motion control system includes a computer and a motion control card; the computer controls the pulsed laser and the motion control card, and the motion control card controls the X-Y two-coordinate workbench and the vertical lifting workbench.

Further, the flexible following tool anode includes an upper section, an elastic middle section, and a lower section, and the upper section and the lower section are connected by the elastic middle section; the upper section includes an insoluble metal wire with sidewall insulation, and the lower section includes a shielding deposition mold with a hollow structure.

Further, the shielding deposition mold is made of a light-transmitting material, and the shielding deposition mold is provided with a deposit.

Further, an insulating glass tube is used to the insoluble metal wire for the sidewall insulation.

Further, the device further includes a working fluid circulation system, the working fluid circulation system includes a reservoir, a micropump, a filter, and a throttle valve; the micropump has a port connected to the reservoir and an outlet connected to the working tank, and the filter and the throttle valve are connected in series in a loop.

Further, the workpiece processing system further includes an oscilloscope; and the oscilloscope is connected to the DC pulse power supply.

Further, the elastic middle section is a flexible spring.

A method for microelectrodeposition through a laser assisted flexible following tool electrode includes the following steps:

performing a surface pretreatment on the cathode substrate;

writing a program and inputting it into control software of the computer;

connecting the cathode substrate to the negative electrode of the DC pulse power supply and fixing it in the working tank, and placing the working tank on the vertical lifting workbench;

connecting the flexible following tool anode to the positive electrode of the DC pulse power supply, clamping it by the work arm of the X-Y two-coordinate workbench, and placing it in the working tank, the lower section of the flexible following tool anode being in close contact with the cathode substrate through the action of the flexible spring;

adjusting a position of a laser spot so that the spot is focused above the cathode substrate in a region of the shielding deposition mold;

adding a deposition solution, so that the cathode substrate and a part of the upper section of the flexible following tool anode are immersed in the deposition solution;

turning on the micropump to circulate the deposition solution to ensure a uniform concentration of the deposition solution in the working tank; and turning on the pulsed laser, and at the same time, controlling the motion path of the X-Y two-coordinate workbench according to written code, so that a desired shape is deposited in the shielding deposition mold.

Further, the cathode substrate is subjected to polishing, degreasing, water washing, weak erosion, water washing, and drying pretreatment in sequence, the DC pulse power supply has a voltage adjustable in a range of 0-20 V, and a duty cycle of 0-100%.

Further, the pulsed laser is one selected from a group consisting of an excimer laser, a fiber laser, and a yttrium aluminium garnet (YAG) laser, and a laser focus is focused at a position 0.1-1 mm above the cathode substrate; a liquid level of the deposition solution immerses the upper section of the flexible following tool anode by 2-10 mm, and a temperature of the deposition solution is maintained at 20-70° C.

Preferably, the micropump has a working pressure less than 2 bar and a flow rate less than 0.5 L/min, and flow of the solution has a tiny disturbance to a liquid level of the deposition solution.

Technical advantages and beneficial effects of the present invention:

(1) The flexible following tool electrode can effectively restrict a dispersion region of an electric field and a reaction region of electrodeposition, and enhance localization of the electrodeposition, and forming precision is controlled by a shielding mold, thus effectively solving the problems of low forming precision and poor processing quality of microelectrodeposition.

(2) An elastic middle section of the flexible following tool electrode ensures that the shielding mold is in close contact with the cathode substrate during tool setting without damaging the shielding mold; the shielding mold at the lower section may be continuously raised with the increase of the height of the deposit, and a flexible joint can also enable the tool electrode to perform spatial scanning movement, thus effectively controlling the size and shape of the part, and improving the processing efficiency.

(3) The laser is irradiated in the shielding mold to enhance micro-region stirring, accelerate charge transfer, and improve mechanical properties of the deposited layer, thus effectively reducing defects such as cracking and pores in the deposit, and improving the deposition quality.

DESCRIPTION OF THE EMBODIMENTS

The present invention will be further described below with reference to the accompanying drawings and specific implementation cases, but the protection scope of the present invention is not limited thereto.

Figure 1:
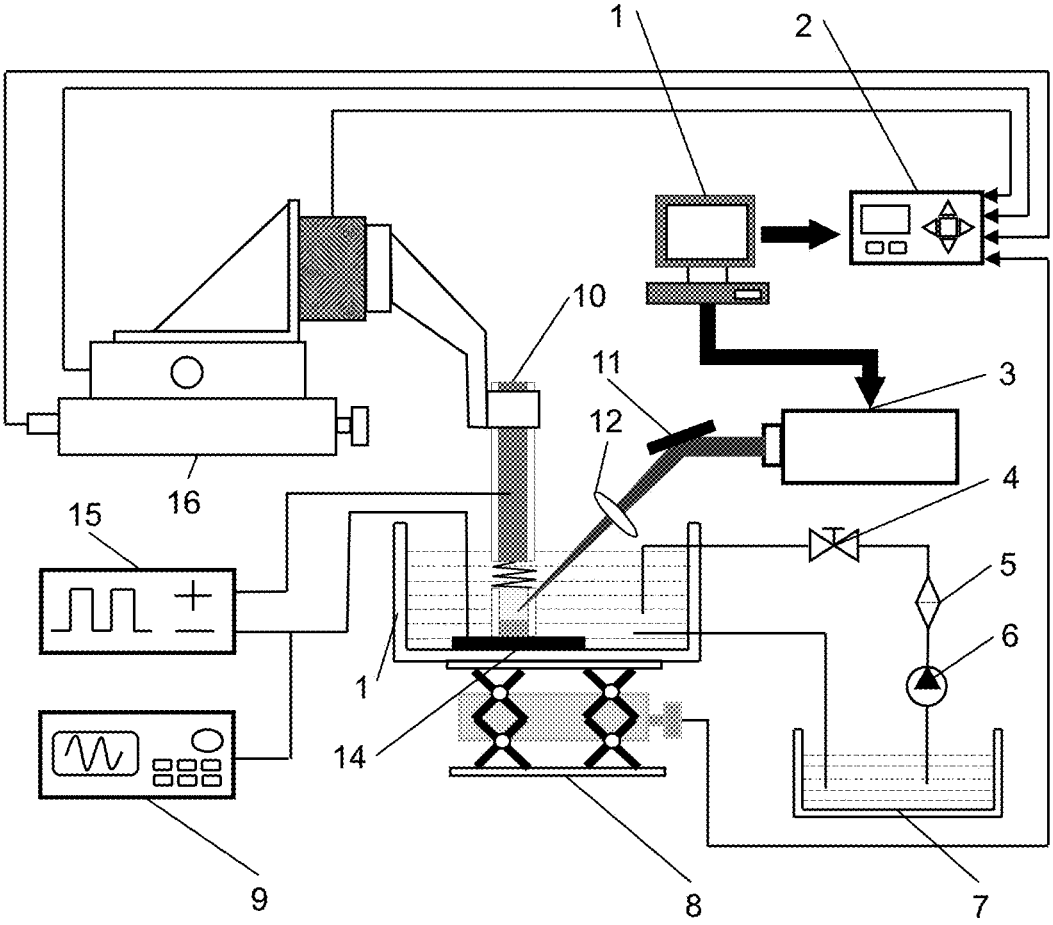
FIG. 1 is a system diagram of microelectrodeposition through a laser assisted flexible following tool electrode.

Referring to FIG. 1, a device for microelectrodeposition through a laser assisted flexible following tool electrode includes a workpiece processing system, a laser irradiation system, and a motion control system. The workpiece processing system includes an X-Y two-coordinate workbench 16, a vertical lifting workbench 8, a DC pulse power supply 15, a working tank 13, a flexible following tool anode 10, and a cathode substrate 14. The flexible following tool anode 10 is connected to a positive electrode of the DC pulse power supply 15 and is clamped by a work arm of the X-Y two-coordinate workbench 16. The cathode substrate 14 is connected to a negative electrode of the DC pulse power supply 15. The flexible following tool anode 10 and the cathode substrate 14 are arranged from top to bottom, and the flexible following tool anode 10 and the cathode substrate 14 are both arranged in an electrolyte in the working tank 13. The working tank 13 is arranged on the vertical lifting workbench 8. The laser irradiation system includes a pulsed laser 3, a reflector 11, and a focusing lens 12. A laser beam emitted by the pulsed laser 3 is reflected by the reflector 11, then focused by the focusing lens 12, and then irradiated on the flexible following tool anode. The motion control system includes a computer 1 and a motion control card 2. The computer 1 controls the pulsed laser 3 and the motion control card 2, and the motion control card 2 controls the X-Y two-coordinate workbench 16 and the vertical lifting workbench 8.

The flexible following tool anode 10 includes an upper section, an elastic middle section, and a lower section. The upper section and the lower section are connected by the elastic middle section, and the elastic middle section is a flexible spring 19. The upper section includes an insoluble metal wire 17 with sidewall insulation, and the lower section includes a shielding deposition mold 21 with a hollow structure. The shielding deposition mold 21 is made of a light-transmitting material, and a deposit 22 is arranged in the shielding deposition mold 21. An insulating glass tube 18 is used to the insoluble metal wire 17 for the sidewall insulation. A working fluid circulation system is further included. The working fluid circulation system includes a reservoir 7, a micropump 6, a filter 5, and a throttle valve 4. The micropump 6 has a port connected to the reservoir 7 and an outlet connected to the working tank 13. The filter 5 and the throttle valve 4 are connected in series in a loop. The workpiece processing system also includes an oscilloscope 9. The oscilloscope 9 is connected to the DC pulse power supply 15.

The upper section of the flexible following tool anode 10 includes the insoluble metal wire 17 with sidewall insulation. This structure can restrict the electric field to a top region of the metal wire. The lower section includes the insulating shielding deposition mold 21 to further restrict a dispersion region of the electric field and restrict a reaction region of electrodeposition. The upper and lower sections are connected by the flexible spring 19 to ensure that the lower section of the anode is in close contact with the cathode substrate 14 without damaging the insulating shielding mold, and to ensure supplementation of cations and evolution of cathode gas.

The cross-sectional shape of the deposit is controlled by changing the shape of the shielding deposition mold 2, and the X-Y two-coordinate workbench 16 clamps the flexible following tool anode 10 by the work arm to control its motion path.

As shown in FIG. 1, the computer 1 is connected to the pulsed laser 3 and the motion control card 2. The computer 1 can control laser parameters of the pulsed laser 3 and can also transmit written code to the motion control card 2. The oscilloscope 9 is connected to the DC pulse power supply 15 to monitor current parameters in real time. The working tank 13 is arranged on the vertical lifting workbench 8, the cathode substrate 14 is placed in the working tank 13, and the flexible following tool anode 10 is clamped by the work arm of the X-Y two-coordinate workbench 16 and placed in the working tank 13. A laser beam is emitted from the pulsed laser 3, a transmission path thereof is changed by the reflector 11, and the laser beam then passes through the focusing lens 12. The focused pulsed laser 23 penetrates through the shielding deposition mold 21 and is focused above the cathode substrate 14. The motion control card 2 controls motion trajectories of the X-Y two-coordinate workbench 16 and the vertical lifting workbench 8 to deposit a complex member. The deposition solution is stored in the reservoir 7, and the micropump 6 provides power to transport the deposition solution from the reservoir 7 to the working tank 13 through the filter 5 and the throttle valve 4, and the deposition solution finally returns to the reservoir 7 to implement circulation.

Figure 2:
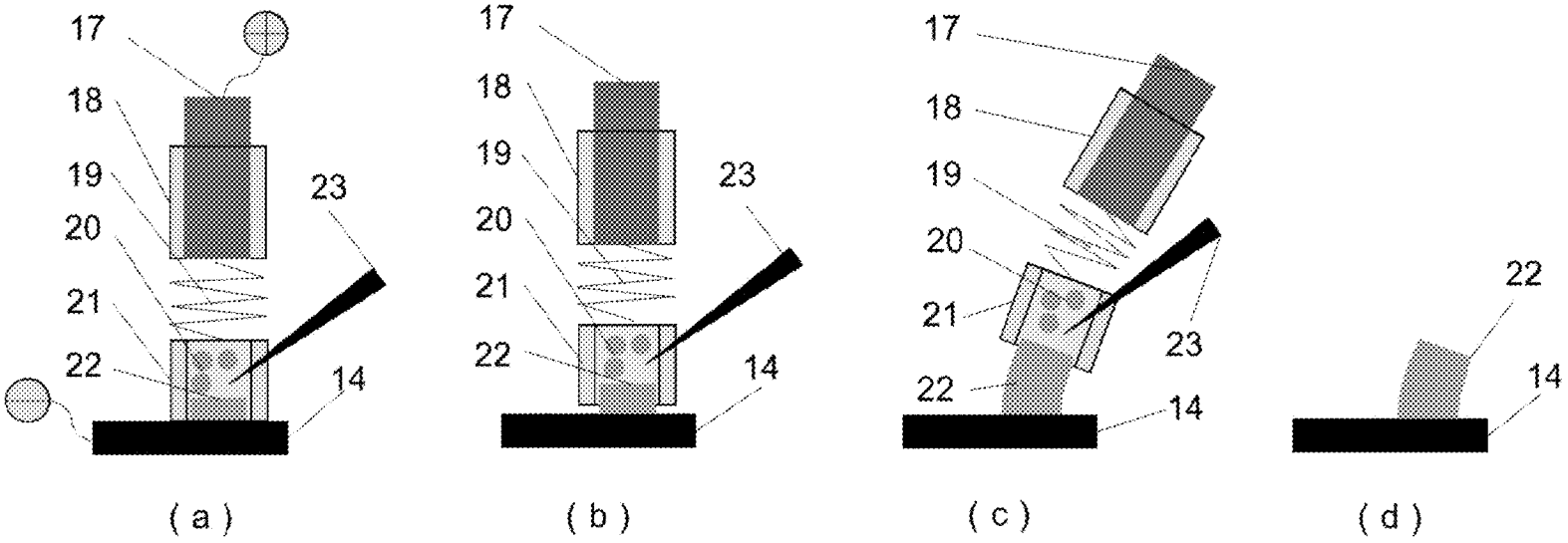
FIG. 2 is a diagram of working principles of a flexible following tool electrode, wherein (a) is a schematic structural diagram of a flexible following tool anode and a cathode substrate; (b) is a schematic diagram of an initial reaction between the flexible following tool anode and the cathode substrate; (c) is a schematic diagram during the reaction of the flexible following tool anode and the cathode substrate; and (d) is a schematic diagram after the reaction.

As shown in FIG. 2 where (a) is a schematic structural diagram of a flexible following tool anode and a cathode substrate; (b) is a schematic diagram of an initial reaction between the flexible following tool anode and the cathode substrate; (c) is a schematic diagram during the reaction of the flexible following tool anode and the cathode substrate; and (d) is a schematic diagram after the reaction, the upper section of the flexible following tool anode 10 is the insoluble metal wire 17 to which the insulating glass tube 18 is used for sidewall insulation, the lower section is an insulating shielding deposition mold 21, and the upper and lower sections are connected by the flexible spring 19. The electrodeposition reaction is carried out in the shielding deposition mold 21. When the deposit 22 is stacked to a certain height, the upper section of the following flexible following tool anode 10 is controlled to be raised, and metal can be continuously deposited in the shielding deposition mold 21. At the same time, by controlling the spatial scanning movement of the flexible following tool anode 10, the complex-shaped deposit 22 can be obtained. The thermal action generated by the irradiation of the focused pulsed laser 23 promotes convection, mass transfer, and crystallization of cations 20 in the shielding deposition mold 21, and accelerates discharge of the gas in the shielding deposition mold 21 from a joint of the flexible spring 19. The cations 20 enter the shielding deposition mold 21 from the joint of the flexible spring 19 to continue the deposition reaction until the corresponding member is deposited.

The specific implementation method of the present invention is as follows:

An electrodeposition solution consists of 120 g/L nickel sulfate ($NiSO_4.6H_2O$), 20 g/L ferrous sulfate ($FeSO_4.7H_2O$), 40 g/L nickel chloride ($NiCl_2.6H_2O$), 40 g/L boric acid ($H_3BO_3$), 20 g/L sodium citrate ($Na_3C_6H_5O_7.2H_2O$), 3 g/L saccharin, and 2 g/L sodium dodecyl sulfate ($C_{12}H_{25}SO_4Na$), the PH is maintained at 3±0.02, and the temperature is maintained at 40-60° C. The cathode substrate is 1Cr18Ni9Ti stainless steel. The insoluble metal wire is a platinum wire. The laser is a YAG nanosecond pulsed laser. The DC pulse power supply has a voltage of 0-30 V, a frequency of 1-5000 Hz, and a duty cycle of 0-100%.

The deposition method using the device for microelectrodeposition through a laser assisted flexible following tool electrode includes the following steps:

performing a surface pretreatment on the cathode substrate 14;

writing a program and inputting it into control software of the computer 1;

connecting the cathode substrate 14 to the negative electrode of the DC pulse power supply 15 and fixing it in the working tank 13, and placing the working tank 13 on the vertical lifting workbench 8;

connecting the flexible following tool anode 10 to the positive electrode of the DC pulse power supply 15, clamping it by the work arm of the X-Y two-coordinate workbench 16, and placing it in the working tank 13, the lower section of the flexible following tool anode 10 being in close contact with the cathode substrate 14 through the action of the flexible spring 19;

adjusting a position of a laser spot so that the laser spot is focused above the cathode substrate 14 in a region of the shielding deposition mold 21;

adding a deposition solution, so that the cathode substrate 14 and a part of the upper section of the flexible following tool anode 10 are immersed in the deposition solution;

turning on the micropump 6 to circulate the deposition solution to ensure a uniform concentration of the deposition solution in the working tank 13; and turning on the pulsed laser 3, and at the same time, controlling the motion path of the X-Y two-coordinate workbench 16 according to written code, so that a desired shape is deposited in the shielding deposition mold 21.

The cathode substrate 14 is subjected to polishing, degreasing, water washing, weak erosion, water washing, and drying pretreatment in sequence, the DC pulse power supply 15 is has a voltage adjustable in a range of 0-20 V, and a duty cycle of 0-100%. The pulsed laser 3 is one selected from a group consisting of an excimer laser, a fiber laser, and a YAG laser, and a laser focus is focused at a position 0.1-1 mm above the cathode substrate 14. A liquid level of the deposition solution immerses the upper section of the flexible following tool anode 10 by 2-10 mm, and a temperature of the deposition solution is maintained at 20-70° C.

Specifically, the deposition method using the device for microelectrodeposition through a laser assisted flexible following tool electrode includes the following steps:

51: performing pre-treatment on the cathode substrate 14 to remove impurities and mechanical damage on a surface;

S2: writing program code of a motion path according to a required member shape, and inputting the written code into the computer 1;

S3: preparing an electrochemical deposition solution to keep the PH at 3±0.02 and the temperature at 40-60° C.;

S4: connecting the pretreated cathode substrate 14 to the negative electrode of the DC pulse power supply 15 and fixing it in the working tank 13, and placing the working tank 13 on the vertical lifting workbench 8;

S5: assembling the flexible following tool electrode 10 and connecting it to the positive electrode of the DC pulse power supply 15, clamping it by the work arm of the X-Y two-coordinate workbench 16, and placing it in the working tank 13, the shielding deposition mold 21 at the lower section of the tool anode being in close contact with the cathode substrate 14 through the action of the flexible spring 19;

S6: selecting the YAG nanosecond pulsed laser 3 and adjusting a position of a laser spot so that the spot is focused at 0.1-1 mm above the cathode substrate 14 in the insulating shielding mold 21;

S7: adding the electrodeposition solution so that the liquid level of the electrodeposition solution immerses the upper section of the flexible following tool anode 10 by 2-8 mm;

S8: controlling parameters of the laser by the computer 1, controlling parameters of the DC pulse power supply 15 externally, and connecting the oscilloscope 9 to the DC pulse power supply 15 to monitor the parameters of the DC pulse power supply 15 in real time;

S9: turning on the micropump 6 to circulate the electrodeposition solution; and S10: using the computer to turn on the laser 3 and the motion control card 2, and controlling the motion path of the shielding deposition mold 21 to deposit a three-dimensional shape of the member.

The micropump 6 has a working pressure less than 2 bar and a flow rate less than 0.5 L/min, and flow of the solution has a tiny disturbance to the liquid level of the deposition solution.

The embodiments are preferred implementations of the present invention, but the present invention is not limited to the above implementations. Any obvious improvements, replacements, or variations that can be made by those skilled in the art without departing from the essential content of the present invention all belong to the protection scope of the present invention.

What is claimed is:

1. A device for microelectrodeposition through a laser assisted flexible following tool electrode, comprising a workpiece processing system, a laser irradiation system, and a motion control system, wherein the workpiece processing system comprises an X-Y two-coordinate workbench, a vertical lifting workbench, a direct current (DC) pulse power supply, a working tank, a flexible following tool anode, and a cathode substrate;

the flexible following tool anode is connected to a positive electrode of the DC pulse power supply and is clamped by a work arm of the X-Y two-coordinate workbench; the cathode substrate is connected to a negative electrode of the DC pulse power supply; the flexible following tool anode and the cathode substrate are both arranged in an electrolyte in the working tank, and when energized, an electrochemical loop is formed; and the working tank is arranged on the vertical lifting workbench;

the laser irradiation system comprises a pulsed laser, a reflector, and a focusing lens; a laser beam emitted by the pulsed laser is reflected by the reflector, then focused by the focusing lens, and then irradiated on a lower section of the flexible following tool anode; and the motion control system comprises a computer and a motion control card; the computer controls the pulsed laser and the motion control card, and the motion control card controls the X-Y two-coordinate workbench and the vertical lifting workbench;

wherein the flexible following tool anode comprises an upper section, an elastic middle section, and the lower section, and the upper section and the lower section are connected by the elastic middle section; the upper section comprises an insoluble metal wire with sidewall insulation, and the lower section comprises a shielding deposition mold with a hollow structure.

2. The device for microelectrodeposition through the laser assisted flexible following tool electrode according to claim 1, wherein the shielding deposition mold is made of a light-transmitting material.

3. The device for microelectrodeposition through the laser assisted flexible following tool electrode according to claim 1, wherein an insulating glass tube is used to the insoluble metal wire for the sidewall insulation.

4. The device for microelectrodeposition through the laser assisted flexible following tool electrode according to claim 1, further comprising a working fluid circulation system, the working fluid circulation system comprises a reservoir, a micropump, a filter, and a throttle valve; the micropump has a port connected to the reservoir and an outlet connected to the working tank, and the filter and the throttle valve are connected in series in the loop.

5. The device for microelectrodeposition through the laser assisted flexible following tool electrode according to claim 1, wherein the workpiece processing system further comprises an oscilloscope; and the oscilloscope is connected to the DC pulse power supply.

6. The device for microelectrodeposition through the laser assisted flexible following tool electrode according to claim 1, wherein the elastic middle section is a flexible spring.

* * * * *